US005921840A

United States Patent [19]

Diresta et al.

[11] Patent Number: 5,921,840

[45] **Date of Patent: *Jul. 13, 1999**

[54] SQUEEZABLE BALL-LIKE TOY SIMULATING ORGANIC OBJECT

[76] Inventors: Joseph G. Diresta; James Diresta, both of 1078 W. Broadway, Woodmere, N.Y. 11598

[ * ] Notice: This patent is subject to a terminal disclaimer.

[21] Appl. No.: 09/094,874

[22] Filed: Jun. 15, 1998

Related U.S. Application Data

[63] Continuation-in-part of application No. 08/714,417, Sep. 16, 1996, Pat. No. 5,769,682, which is a continuation-in-part of application No. 08/543,615, Oct. 16, 1995, Pat. No. 5,577,723.

[51] Int. Cl.[6] ..... A63H 13/00; A63H 3/52; A63B 43/00

[52] U.S. Cl. ..... 446/198; 446/199; 446/267; 473/594

[58] Field of Search ..... 446/197, 198, 446/199, 183, 226, 267, 486, 490; 473/609, 594

[56] References Cited

U.S. PATENT DOCUMENTS

| | | | |
|---|---|---|---|
| 360,123 | 8/1887 | Rosenberg | 446/267 |
| 494,410 | 3/1893 | Carpenter | 446/183 |
| 1,352,047 | 9/1920 | Boje, Jr. | 446/183 |
| 1,567,973 | 12/1925 | Mendelson | 446/198 |
| 2,631,407 | 3/1953 | Rempel | 446/499 X |
| 2,668,394 | 2/1954 | Auzin | 446/183 |
| 4,929,211 | 5/1990 | Resnick et al. | 446/267 X |
| 4,952,190 | 8/1990 | Tarnoff et al. | 446/267 |
| 5,035,425 | 7/1991 | Edwards | 273/DIG. 10 X |
| 5,035,426 | 7/1991 | Spector | 273/DIG. 20 X |
| 5,205,773 | 4/1993 | Koepcke et al. | 446/198 X |
| 5,419,730 | 5/1995 | Direst et al. | 446/197 X |

FOREIGN PATENT DOCUMENTS

| | | | |
|---|---|---|---|
| 1032217 | 6/1953 | France | 446/198 |

*Primary Examiner*—D. Neal Muir
*Attorney, Agent, or Firm*—Michael Ebert

[57] ABSTRACT

A squeezable ball-like toy having an outer spheroidal casing molded of resilient synthetic plastic material whose exposed surface is contoured to render the casing suggestive of an organic object, such as a humanoid head or human organ. Distributed about the casing are ports creating orifices of varying size and shape. Enclosed within the casing is a core of elastomer material having a distinctive color, the core normally blocking the ports. When the ball-like toy is squeezed and deformed by a player, streams of elastomer integral with the core are then extruded from the orifices to simulate discharges from the organic object. When the toy is released to resume its normal shape, the streams are retracted into the core whereby the toy is then throwable.

14 Claims, 1 Drawing Sheet

SQUEEZABLE BALL-LIKE TOY SIMULATING ORGANIC OBJECT

RELATED APPLICATIONS

This application is a continuation-in-part of the DiResta et al. copending application Ser. No. 08/714,417, now U.S. Pat. No. 5,769,682, filed Sep. 16, 1996, which in turn is a C-I-P of the DiResta et al. application Ser. No. 08/543,615, filed Oct. 16, 1995 entitled "Squeezable Toy Ball" (now U.S. Pat. No. 5,577,723). The entire disclosures of these applications are incorporated herein by reference.

BACKGROUND OF INVENTION

1. Field of Invention

This invention relates generally to squeezable toy playthings, and more particularly to a throwable ball-like toy that resembles an organic object, the toy when squeezed and deformed by a player then simulating a natural discharge from the organic object.

2. Status of Prior Art

This invention is concerned with a squeezable toy ball that qualifies as a "gross" toy; that is to say a toy which is disgusting or in poor taste. However the fact that a toy may be offensive to many adults does not detract from its appeal to children, for children are drawn to such toys as they are to horror films repugnant to adults.

The psychological justification for gross toys is the same as that for classic fairy tales, such as Little Red Riding Hood whose grandmother is devoured by a wolf and Hansel and Gretel in which the witch is burned alive. Horror movies and fairy tales enable a child to vicariously experience the horrors of the real world and, in doing so, to become conditioned to cope with these horrors. Thus while the organs of the human body, such as the brain, the pancreas and the intestines are somewhat gruesome and replicas of these organs may be disgusting, they nevertheless hold a fascination for children.

Our prior U.S. Pat. No 5,577,723 discloses a "gross" toy constituted by a squeezable ball resembling a human intestine. The ball is formed by a spherical shell of transparent plastic film encasing a hollow core of resilient plastic material whose surface is configured to resemble a human intestine. Injected into the hollow core through an orifice therein is a charge of oil. When the ball is squeezed and deformed by a player, oil intermingled with air is then discharged through the orifice into spaces between the core and the shell, and when the ball is released to resume its normal shape, oil and air are sucked back into the core. These actions produce gurgling sounds suggestive of the activity of an intestine.

The present invention deals with another aspect of a human organ which in the context of a ball-like toy renders it gross. That activity is the process of suppuration in which as a result of an infection, pus is formed and discharged from an abscess or other lesion. Pus is a viscous, yellowish-white fluid formed in infected tissue, the pus consisting of white blood cells, cellular debris and necrotic tissue. The discharge of pus from diseased tissues, though a common experience, is not a pleasant sight. However, the invention is not limited to balls which resemble human organs, for it encompasses any organic object in somewhat spherical form, such as a humanoid or animal head or that of a monster.

SUMMARY OF INVENTION

In view of the foregoing, the main object of this invention is to provide a squeezable ball-like toy resembling an organic object which when the toy is squeezed it simulates natural discharges from the organic object whereby the ball qualifies as a "gross" toy.

A significant advantage of a squeezable toy in accordance with the invention is that it also functions as a soft play ball that may be hurled, struck and caught by a player.

More particularly, an object of this invention is to provide a toy of the above type which suggests a human intestine which when subjected to manual pressure, then discharges simulated streams of pus from ports distributed about the ball-like toy, and which when the pressure is released retracts these streams.

Also an object of this invention is to provide a toy of the above type which is inexpensive to mass-produce and is capable of withstanding rough handling.

Briefly stated, these objects are attained by a squeezable ball-like toy having an outer spheroidal casing molded of resilient synthetic plastic material whose exposed surface is contoured to render the casing suggestive of an organic object. Distributed about the casing are ports creating orifices of varying size and shape.

Enclosed within the casing is a core of elastomer material having a distinctive color, the core normally blocking the ports. When the toy is squeezed and deformed by a player, streams of elastomer integral with the core are then extruded shape the ports to simulate discharges from the organic object. When the toy is released to resume its normal form, the streams are retracted into the core whereby the ball-like toy is then throwable.

BRIEF DESCRIPTION OF DRAWING

For a better understanding of the invention reference is made to the detailed description to follow which is to be read in conjunction with the accompanying drawings is which.

DESCRIPTION OF INVENTION

First Embodiment

A squeezable toy ball in accordance with the invention includes a spheroidal outer casing molded of resilient plastic material whose exterior surface is contoured to render the casing suggestive of an organic object. The organic object may take the form of a humanoid or animal-like head, or that of a fanciful monster, or it may take the form of a human organ, such as a brain or intestine.

In the embodiment of the invention the organic object simulates a human organ. But it is to be understood that the invention is applicable to any organic object capable of exuding a discharge, such as that of blood, pus or vomit.

Figure 1:
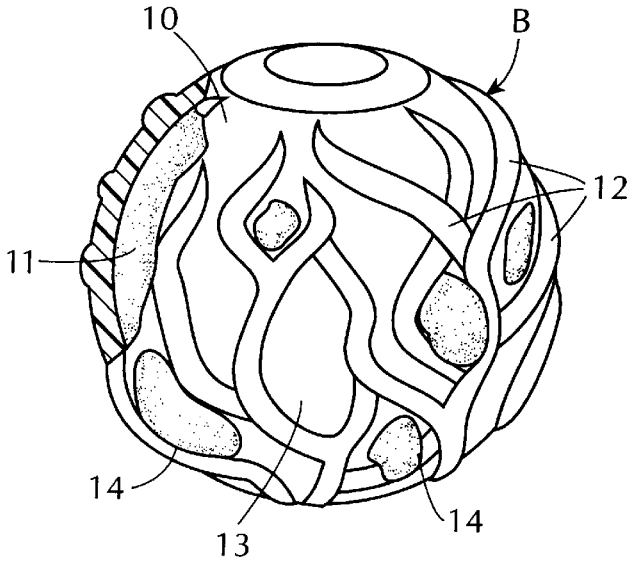
FIG. 1 is a perspective view of an embodiment of a squeezable ball-like toy in accordance with the invention which resembles a human organ, the casing being cut away to expose the inner core.

FIG. 1 shown a squeezable ball-like toy B in accordance with the invention consisting of a spheroidal casing 10 and an inner core 11 enclosed within the casing. Casing 10 is molded of resilient plastic material, such as polyurethane or polyvinyl chloride to form a generally spherical hollow casing whose exposed surface is irregularly indented to define a pattern of raised ridges 12 having depressed regions 13 in the spaces between adjacent ridges.

The pattern formation is such as to simulate the outer appearance of a human organ, such as an intestine or brain. Distributed about the casing in the depressed regions thereof 13 are ports 14 creating orifices of varying size and shape. The orifices may in some cases be slit-like.

Figure 2:
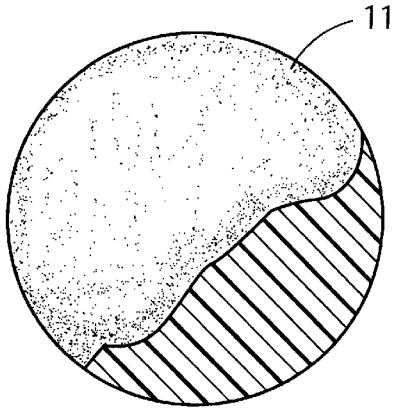
FIG. 2 illustrates the inner core of the ball.

Inner core 11, as separately shown in FIG. 2, is normally spherical in shape. The diameter of core 11 matches the inner diameter of hollow casing 10 so that the inner core blocks ports 14 in the casing. A preferred technique for producing the ball is to mold casing 10 in two complementary hemispherical halves, and then place these halves about the pre-molded inner core 11, the halves then being sealed together to complete the ball.

Core 11 is fabricated of an elastomer, this being a polymer possessing elastic properties. The elastomer from which core 11 is made must exhibit what is referred to in elastomer technology as "long-range" elasticity. This represents the ability of the elastomer to undergo stretching to at least twice its original length and to retract rapidly to virtually its original length when released. Among moldable elastomers suitable for core 11 are urethane rubber and silicone rubber. The elastomer preferably has a low density so that it takes relatively little squeezing pressure applied to the ball to stretch the elastomer.

The elastomer is dyed, stained or otherwise colored so that it resembles the color of yellowish-white pus. And the resilient plastic from which casing 10 is formed has a color imparted to its composition which is similar to the color of the outer surface of the human organ simulated by the casing.

Figure 3:
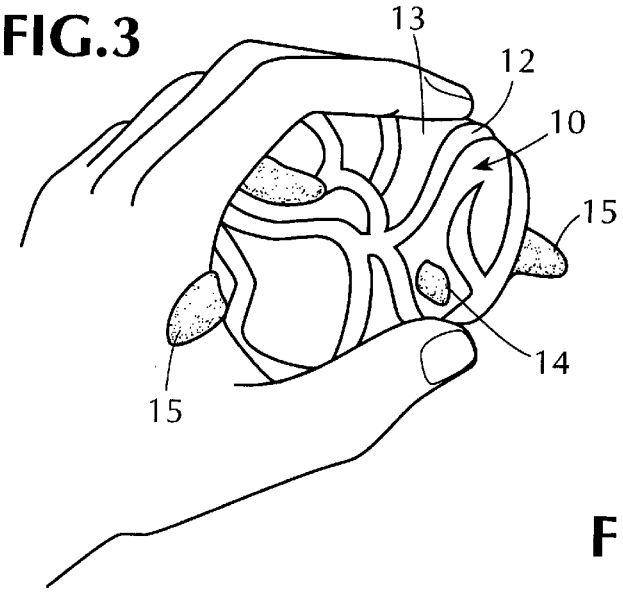
FIG. 3 shows the toy being squeezed and deformed to extrude multiple pus-like streams.

When ball B is grasped by a player and squeezed and deformed, as shown in FIG. 3, the resultant pressure applied to inner core 11 seeks to stretch the elastomer. But since inner core 11 is confined within casing 10, the elastomer is only free to stretch through port holes 14 in the casing.

As a consequence, extruded from the several ports 14 as the ball is being squeezed, are multiple streams 15 of elastomer having a pus-like color, making it seem that the human organ which the ball resembles is discharging pus.

The cross-sectional shape of each pus stream 15 corresponds to that of the port hole 14 from which the stream is exuded. Hence the smaller the size of the port, the longer the stream for a given amount of pressure applied to the ball. A large size port therefore yields a relatively thick and short stream, whereas a small size port hole yields a relatively thin and long stream. And when the port is circular, the stream tends to bulge out beyond the port to form a globular discharge.

Figure 4:
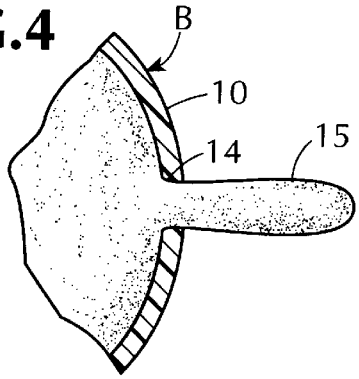
FIG. 4 illustrates one such stream as the toy is being squeezed and deformed.
Figure 5:
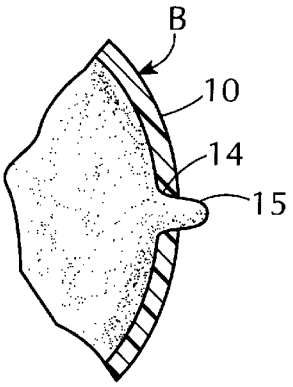
FIG. 5 illustrates the same stream as the toy proceeds to resume its normal shape.

FIG. 4 shows a single port hole 14 and the pus-like stream 15 being exuded from this hole as ball B is being squeezed by a player. When the player thereafter releases pressure on the ball, then stream 15 which is an integral extension of the elastomer inner core 11 confined within casing 10, is then retracted into the casing as shown in FIG. 5.

When the streams are fully retracted in the casing, the ball which is no longer being squeezed then resumes its normal spherical form, as shown in FIG. 1.

Since the ball has an elastomer inner core and an outer casing of resilient plastic material, it qualifies as a soft ball and may be played with as such. Thus the ball may be thrown, struck or caught by a player.

When the casing is molded to assume a humanoid or animal-like head form whose head has eyes, ears and a mouth, ports creating orifices in the casing are then aligned with the eyes, ears and mouth so that when the ball is squeezed, streams of elastomer are exuded from these ports. In this arrangement, the elastomer core is preferably blood colored so that the resultant discharges from the head simulate a discharge of blood.

But regardless of the simulated nature of the discharges, the color imparted to the elastomer material of the core should be distinctive in contrast to that of the organic object simulated by the outer casing.

Also the elastomer core may have different colors applied to segments of the core. For example, one segment could be blood colored, another segment pus colored, and a third segment the color of another organic body secretion. Hence when the ball containing the multi-colored core is squeezed, the resultant streams of elastomer exuded from the ports are in different colors.

Second Embodiment

Figure 6:
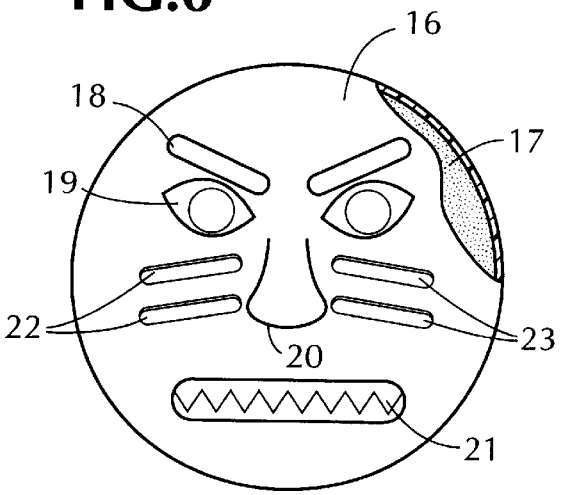
FIG. 6 illustrates another embodiment of the ball-like toy which resembles a humanoid head.

In the embodiment which is illustrated in FIG. 6, the ball-like toy resembles a decapitated humanoid head formed by a spheroidal outer casing 16 and a core 17 enclosed therein formed of elastomeric material.

Casing 16 is molded of resilient synthetic plastic material whose outer surface is contoured to define the facial features of the head including eyebrows 18, eyes 19, a nose 20 and a mouth 21. Casing 16 has ports molded therein constituted by two pairs of slits 22 and 23 radiating from opposite sides of the region below the nose.

When therefore the humanoid head is squeezed by a player and deformed by the applied pressure, streams of core elastomer are extruded from slits 22 and 23 to simulate the discharge of pus from the head. When the pressure is released, the streams are then retracted into the core and the face of the head is again clear. Since the head is not soft and ball-like, it may be thrown or kicked by the player.

The gross aspect of this humanoid head is not only that it is capable of exuding pus, but also that the head can, in effect, be abused by the player. It is not uncommon in primitive tribes in South America to use a head severed from an enemy as a playball, thereby defying and insulting the tribal enemy. And in medieval times it was not uncommon to mount the severed head of an enemy on a display pike.

Hence a severed head playball in accordance with the invention may be given the facial features of a universally hated historical figure or even that of an unpopular political figure, thereby making the figure a play object.

While there has been shown and disclosed preferred embodiments of the invention, it will be appreciated that many changes may be made therein without departing from the spirit of the invention.

We claim:

1. A squeezable ball-like toy comprising:

A. a hollow spheroidal casing molded of resilient plastic material having ports creating orifices therein distributed about the casing; and B. an inner core confined within the casing formed of an elastomer, said core normally blocking said ports whereby when the ball is squeezed and deformed by pressure applied thereto, streams of elastomer integral with the core are extruded from said ports, and when the pressure is released, the streams are retracted into the core, said casing being molded to resemble an organic object whereby when the toy is squeezed, the resultant streams simulate natural discharges from said object.

2. A squeezable toy as set forth in claim 1, in which the casing is formed of polyurethane.

3. A squeezable toy as set forth in claim 1, in which the core is formed of silicone rubber.

4. A squeezable toy as set forth in claim 1, in which the inner core is spherical and fits snugly within the casing.

5. A squeezable toy as set forth in claim 1, in which the outer surface of the molded casing is contoured to resemble an organic object.

6. A squeezable toy as set forth in claim 5, in which said casing is molded to resemble the outer surface of a human organ.

7. A squeezable toy as set forth in claim 5, in which the organic object is a decapitated humanoid head.

8. A squeezable toy as set forth in claim 7 in which the port from which the core is extruded are facial slits in the head.

9. A squeezable toy as set forth in claim 5, in which the casing has a color imparted thereto that is imitative of the color of the organic object.

10. A squeezable toy as set forth in claim 6, in which the outer surface of the casing is indented to create a pattern of raised ridges simulating an intestine.

11. A squeezable toy as set forth in claim 10, in which said ports are formed in depressed regions between adjacent ridges of said pattern.

12. A squeezable toy as set forth in claim 5, in which said ports vary in size and shape.

13. A squeezable ball as set forth in claim 6, in which the inner core has a color imparted thereto similar to the color of pus whereby said streams appear to be a pus discharge from the organ.

14. A squeezable toy as set forth in claim 1, in which the casing is molded of polyurethane.

* * * * *